US006951487B2

(12) United States Patent
Ozai

(10) Patent No.: US 6,951,487 B2
(45) Date of Patent: Oct. 4, 2005

(54) MULTICONDUCTOR CONNECTOR ADAPTED TO BE CONNECTED TO A PLURALITY OF PAIRED CABLES FOR HIGH-SPEED TRANSMISSION A SIGNAL

(75) Inventor: Kazuyuki Ozai, Tokyo (JP)

(73) Assignee: DDK LTD, Tokyo (JP)

( * ) Notice: Subject to any disclaimer, the term of this patent is extended or adjusted under 35 U.S.C. 154(b) by 558 days.

(21) Appl. No.: 10/156,568

(22) Filed: May 28, 2002

(65) Prior Publication Data

US 2003/0064625 A1 Apr. 3, 2003

(30) Foreign Application Priority Data

Sep. 28, 2001 (JP) ..... 2001-301266

(51) Int. Cl.[7] ..... H01R 24/00
(52) U.S. Cl. ..... 439/637
(58) Field of Search ..... 439/108, 608, 439/676, 637, 660, 731

(56) References Cited

U.S. PATENT DOCUMENTS 4,824,383 A * 4/1989 Lemke ..... 439/108
5,176,538 A * 1/1993 Hansell et al. ..... 439/607
6,217,372 B1 * 4/2001 Reed ..... 439/497
2002/0182904 A1 * 12/2002 Siebert ..... 439/86

* cited by examiner

*Primary Examiner*—Chandrika Prasad
(74) *Attorney, Agent, or Firm*—Baker Botts L.L.P.

(57) ABSTRACT

A multiconductor connector for high-speed transmission signal for connecting a plurality of paired cables includes an insulator plate having signal contacts on its upper and lower surfaces. The signal contacts are arranged in a row on each of the upper and lower surfaces to form pairs of the two signal contacts aligned with each other above and below across the insulator plate. The insulator plate has a thickness so determined that when a pair of terminal of each of the paired cables are exposed at their one ends by removing their insulating coverings and then fitted on the insulator plate without changing the initial spacing between the pair of terminals in a manner embracing the insulator plate by the pair of terminals on the upper and lower surfaces, the pair of terminals are electrically connected to a pair of the signal contacts on the upper and lower surfaces of the insulator plate. With this arrangement, good impedance characteristics at the one ends of the paired cables can be maintained.

4 Claims, 3 Drawing Sheets

MULTICONDUCTOR CONNECTOR ADAPTED TO BE CONNECTED TO A PLURALITY OF PAIRED CABLES FOR HIGH-SPEED TRANSMISSION A SIGNAL

BACKGROUND OF THE INVENTION

This invention relates to a multiconductor connector to be used for a high-speed information transmission signal. In this text, the connector may be expressed as a multiconductor high speed trensmission connector or simply a multiconductor connector, etc. This connector having signal contacts whose spacing is coincident with spacing between terminals of paired or twin cables in order to improve impedance characteristics of the signal route through the cables.

With a multiconductor connector used as a high-speed transmission signal interface in personal computers and the like for monitoring, there has been strong need for multiconductor cable connectors superior in high-speed transmission characteristics in order to fulfil the imposed requirements with respect to multi-function and increase in transmission speed.

In paired or twin cables or dual-axial cables, particularly, there has been a need for maintaining good impedance characteristics at the terminal ends of the paired cables. In general, however, terminals of cables are connected to a connector after the terminals have been bent to meet arrangement of signal contacts, consequently resulting in deteriorated impedance characteristics of the paired cables.

SUMMARY OF THE INVENTION

It is an object of the invention to provide an improved multiconductor high-speed transmission connector which is able to maintain good impedance characteristics at the terminal ends of the paired cables to solve all the above problems of the prior art.

In order to achieve the above object, in a multiconductor high-speed transmission connector for connecting a plurality of paired cables including an insulator plate having on each of its upper and lower surfaces signal contacts arranged in a row to form pairs of two signal contacts aligned with each other above and below across said insulator plate, according to the invention said insulator plate has a thickness so determined that when a pair of terminals of each of said paired cables are exposed at their ends by removing their insulating coverings and then fitted on said insulator plate without changing the initial spacing between said pair of terminals in a manner embracing said insulator plate by said pair of terminals on said upper and lower surfaces, said pair of terminals are electrically connected to a pair of said signal contacts on said upper and lower surfaces of the insulator plate.

Preferably, terminal plates of the signal contacts and terminal plates of ground contacts are alternately arranged with the same pitches on the insulator plate.

In a preferred embodiment, partition plates extending perpendicularly to the insulator plate for ground contacts are each provided between the signal contacts to hold a paired cable to be connected thereto on opposite sides of the cable, and drain wires of the paired cable are connected to the partition plates, respectively.

The multiconductor connector for high-speed transmission signal according to the invention comprising the subject features described above has the following significant functions and effects.

(1) According to the invention, when a pair of terminals of a cable exposed by removing insulating coverings are fitted on an insulator plate without changing the initial spacing between the pair of terminals in a manner embracing the insulator plate on its upper and lower surfaces, the pair of terminals can be electrically connected to a pair of signal contacts arranged on the upper and lower surfaces of the insulator plate without requiring the bending of the terminals of the cable, so that good impedance characteristics at the terminal ends of paired cables can be maintained.

(2) According to the invention it is possible to provide a multiconductor high-speed transmission connector which is easy to manufacture and simple and inexpensive.

The invention will be more fully understood by referring to the following detailed specification and claims taken in connection with the appended drawings.

DESCRIPTION OF THE PREFERRED EMBODIMENTS

Figure 1:
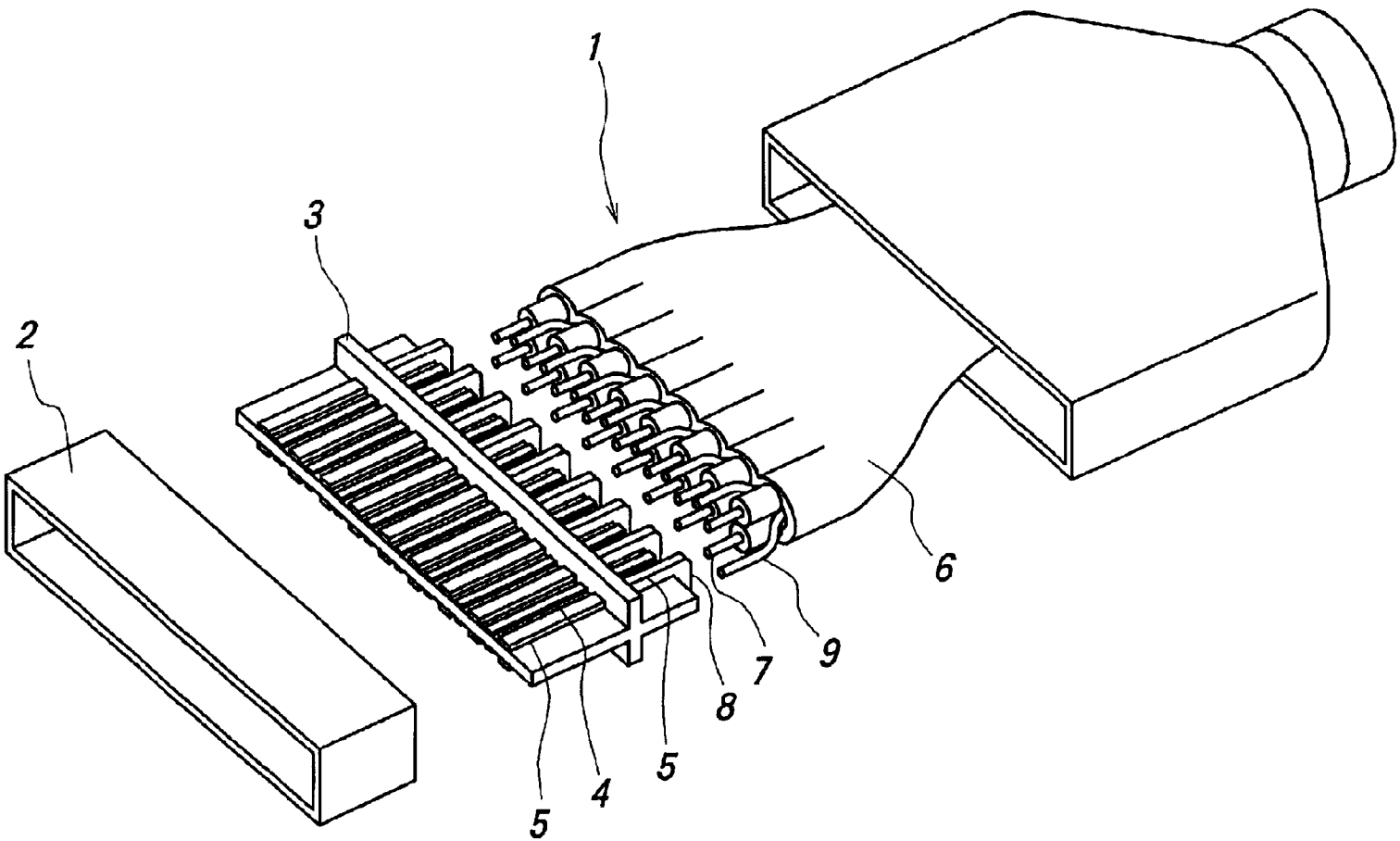
FIG. 1 is an exploded perspective view of a multiconductor high-speed transmission connector according to a preferred embodiment of the invention.

FIGS. 1 to 4 illustrate multiconductor high-speed transmission interface connector according to one preferred embodiment of the invention. The connector 1 includes a fitting shell 2 to be connected to an external plug connector and an insulator plate 3 formed of an insulating material consisting of a main body block and flat plate portions on opposite side of and integrally formed with the main body block. A plurality of signal contact plates 4 and a plurality of ground contact plates 5 are alternately arranged with the same pitches on the upper and lower surfaces of the insulator plate 3.

Figure 2:
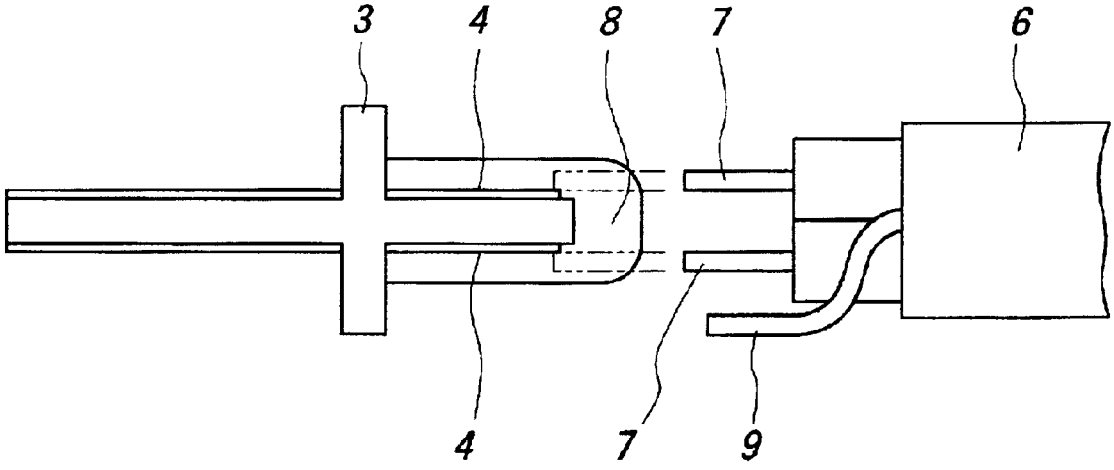
FIG. 2 is a side view of an insulator plate used in the connector according to the invention and part of a cable.
Figure 3:
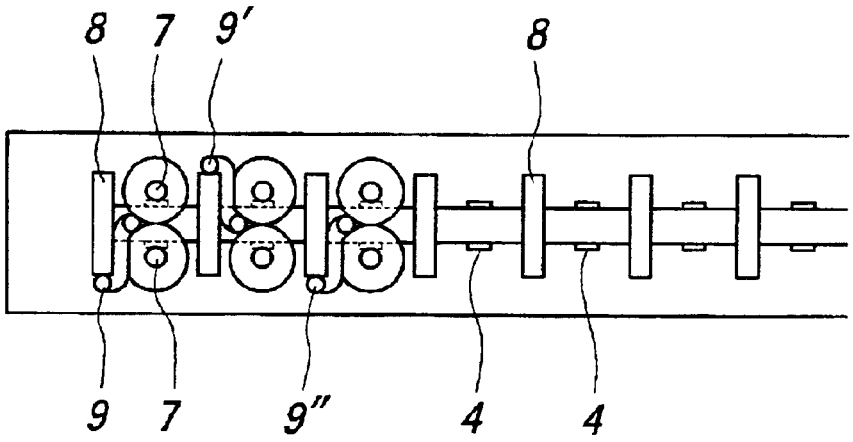
FIG. 3 is a front elevation of the insulator plate used in the connector according to the invention and paired cables.

As shown in the side view of FIG. 2 and in the front view of FIG. 3, moreover, the thickness of the insulator plate 3 is so determined that when a pair of terminals 7 of each paired cable 6 are exposed at their one ends by removing their insulating covering and then fitted on the insulator plate 3 without changing the spacing between the pair of terminals 7 so as to embrace the insulator plate 3 on its opposite sides, the pair of terminals 7 are electrically connected to a pair of signal contact plates 4 on the opposite sides of insulator plate 3. In this case, the paired cable includes only one pair of conductors therein. A plurality of such paired cables are connected to the connector in the illustrated embodiment.

Figure 4:
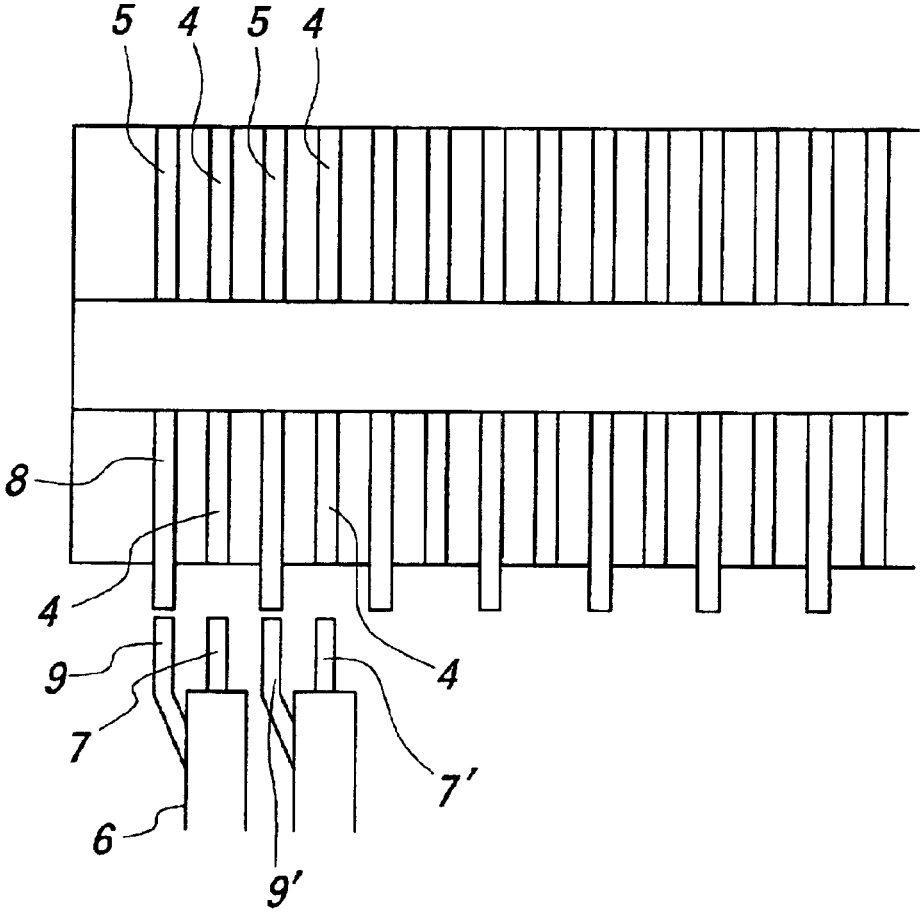
FIG. 4 is a plan view of the insulator plate used in the connector according to the invention and parts of cables.

As evidently illustrated in the plan view of FIG. 4, ground contact plates 5 are arranged between the signal contact plates 4, respectively. Formed on that side of each of the ground contact plates 5 to which a cable is connected is a partition plate 8 extending perpendicularly to the insulator plate 3. Ends of the cables 6 are held on their opposite sides by the partition plates 8, respectively.

Each of the cables 6 has a drain wire 9 which is connected to a part of the held ground contact plate 5. In connecting the drain wires, preferably the drain wire 9 of a cable 6 is connected to the upper face of the ground contact plate 5 positioned on the right side of the cable 6, subsequently the drain wire 9' of the next cable 6' is connected to the lower face of the ground contact plate 5 positioned on the right side of the cable 6', and so forth in an alternate manner concerning connected positions on the ground contact plates 5 (FIG. 3).

While the invention has been particularly shown and described with reference to the preferred embodiment thereof, it will be understood by those skilled in the art that the foregoing and other changes in form and details can be made therein without departing from the spirit and scope of the invention.

What is claimed is:

1. A multiconductor connector adapted to be connected to a plurality of paired cables for high-speed transmission of a signal, wherein each of the paired cables comprise a first terminal and a second terminal, and a distance between the first terminal and the second terminal is equal to a predetermined distance, wherein the connector comprises:

an insulator plate having a predetermined thickness, wherein the insulator plate comprises:

an upper surface comprising a first plurality of signal contacts formed thereon; and a lower surface opposite the upper surface, wherein the lower surface comprises a second plurality of signal contacts formed thereon, and each of the second plurality of signal contacts is aligned with a corresponding one of the first plurality of signal contacts, wherein the predetermined thickness is selected, such that each of the first plurality of signal contacts are adapted to engage a corresponding one of the first terminals and each of the second plurality of signal contacts are adapted to engage a corresponding one of the second terminals, without altering the predetermined distance.

2. The connector of claim 1, further comprising:

a first plurality of partition plates formed on the upper surface of the insulator plate, wherein each of the first plurality of partition plates are positioned between adjacent pairs of the first plurality of signal contacts; and a second plurality of partition plates formed on the lower surface of the insulator plate, wherein each of the second plurality of partition plates are positioned between adjacent pairs of the first plurality of signal contacts, and wherein a pitch of terminal plates of the first plurality of partition plates, the second plurality of partition plates, the first plurality of signal contacts, and the second plurality of signal contacts is the same pitch.

3. The connector of claim 1, wherein each of the paired cables further comprises at least one drain wire, and the connector further comprises:

a first plurality of partition plates formed on the upper surface of the insulator plate, wherein each of the first plurality of partition plates are positioned between adjacent pairs of the first plurality of signal contacts and are connected to the at least one drain wire of a corresponding one of the paired cables; and a second plurality of partition plates formed on the lower surface of the insulator plate, wherein each of the second plurality of partition plates are positioned between adjacent pairs of the first plurality of signal contacts and are connected to the at least one drain wire of a corresponding one of the paired cables.

4. A multiconductor connector comprising:

a plurality of paired cables, wherein each of the paired cables comprise a first terminal and a second terminal, and a distance between the first terminal and the second terminal is equal to a predetermined distance;

an insulator plate having a predetermined thickness, wherein the insulator plate comprises:

an upper surface comprising a first plurality of signal contacts formed thereon; and a lower surface opposite the upper surface, wherein the lower surface comprises a second plurality of signal contacts formed thereon, and each of the second plurality of signal contacts is aligned with a corresponding one of the first plurality of signal contacts, wherein the predetermined thickness is selected, such that each of the first plurality of signal contacts are adapted to engage a corresponding one of the first terminals and each of the second plurality of signal contacts are adapted to engage a corresponding one of the second terminals, without altering the predetermined distance.

* * * * *